United States Patent [19]

Dragich

[11] Patent Number: 4,723,869

[45] Date of Patent: Feb. 9, 1988

[54] LONG HANDLED TROWEL WITH ADJUSTABLE WEIGHTS

[76] Inventor: Nicholas Dragich, 612 Lark Meadow La., Knoxville, Tenn. 37922

[21] Appl. No.: 854,091

[22] Filed: Apr. 21, 1986

[51] Int. Cl.[4] ..... E01C 19/44

[52] U.S. Cl. ..... 404/97; 404/118; 15/235.4

[58] Field of Search ..... 404/97, 118; 15/235.3, 15/235.4, 235.5, 235.8; 425/458

[56] References Cited

U.S. PATENT DOCUMENTS

| | | | |
|---|---|---|---|
| 923,834 | 6/1909 | Harrop | 15/235.3 |
| 1,021,557 | 3/1912 | Runner | 404/97 X |
| 1,955,101 | 4/1934 | Sloan | 15/235.5 X |
| 4,397,581 | 8/1983 | Jarvis | 404/97 |

*Primary Examiner*—James A. Leppink
*Assistant Examiner*—Matthew Smith
*Attorney, Agent, or Firm*—Pitts and Brittian

[57] ABSTRACT

A trowel (10) for surfacing cement work such as driveways, floors, or the like, is provided. The trowel includes a blade assembly (12) having a flexible blade member (14) with a lower surface and an upper surface. A rib base (22) is mounted on the upper surface (18) of the blade member (14) to provide reinforcement. A handle (32) is pivotally connected at one end portion to the blade assembly (12) such that an operator can move the blade member (14) over the surface of the concrete from a remote location. Adjustable weights (46A–B) can be selectively added to or taken away from the blade assembly (12) to vary the effective weight of the trowel. These weights (46A–B) are selectively positioned on the blade assembly (12) to maintain the ability of the blade member (14) to flex approximate its edge portions, and to enhance the smoothness of a produced surface.

5 Claims, 6 Drawing Figures

LONG HANDLED TROWEL WITH ADJUSTABLE WEIGHTS

TECHNICAL FIELD

This invention relates generally to trowels, and more particularly to trowels having elongated handles such that a user can work on a concrete surface from a remote location. This enables smoothing the surface of concrete work without the production of knee-board depressions, normally occasioned by a worker attempting to smooth the surface while being supported thereon.

BACKGROUND ART

Trowels have heretofor been known and are commonly used in working the surface of concrete, freshly laid for floors, driveways or the like. It is advantageous to work a concrete surface with a trowel from afar, such that the weight of the user does not create depressions in the freshly laid surface. Known prior art devices are described and illustrated in the following U.S. Pat. Nos. 842,770; 1,021,557; 1,590,342; and 4,397,581.

Each of these known prior devices incorporate elongated handles, and means for connecting one end portion of the handle to a blade used to form a surface on freshly laid concrete or the like. One of these devices, namely the device illustrated in U.S. Pat. No. 4,397,581, discloses means for adding weight to the blade of the combination groover, trowel, and bull float which is disclosed. These weights are especially designed to be received within channels or grooves carried by the blade. These channels and grooves further serve to reinforce the blade while substantially restricting the flexibility thereof. It will be noted that these channels extend up to the edge of the blade as shown in FIG. 6 of the '581 patent.

Accordingly, it is an object of the present invention to provide an improved long handled trowel having adjustable weights which do not deleteriously affect the flexibility of the blade proximate its edge portion. In this connection, the flexible blade serves to enhance the smoothness of the surface produced by the device.

It is another object of the present invention to provide such an improved trowel which can be inexpensively manufactured and easily maintained.

Yet another object of the present invention is to provide such a trowel on which adjustable weights can be selectively added to the blade assembly with ease and without the need of removing the handle. These weights are fixed in a horizontal position on the blade assembly to prevent movement during use. Further, the weights are designed such that the mass is equally distributed on opposite sides of the location at which the handle is pivotally connected to the blade assembly.

DISCLOSURE OF THE INVENTION

Other objects and advantages of the present invention will be obvious, and will in part appear hereinafter, and will be accomplished by the present invention which provides an improved long handled trowel with adjustable weights. The trowel includes a blade assembly having a flexible blade of substantially planar configuration in the preferred embodiment. This blade has a lower surface and an upper surface which carries a rib base to provide reinforcement at selected locations. An elongated handle is pivotally connected at one end portion to the blade assembly such that an operator can move the blade member from a remote location. Adjustable weights can be selectively added to or taken from the blade assembly by an operator to vary the effective weight of the trowel. These weights are positioned over the blade member at a location horizontally spaced from the perimeter or edges thereof, thus allowing the blade member proximate its perimeter to flex during troweling operations to produce a smoother surface in the freshly laid concrete work.

BRIEF DESCRIPTION OF THE DRAWINGS

The above-mentioned features of the present invention will be more clearly understood from the consideration of the following description in connection with the accompanying drawings in which.

BEST MODE FOR CARRYING OUT THE INVENTION

Figure 1:
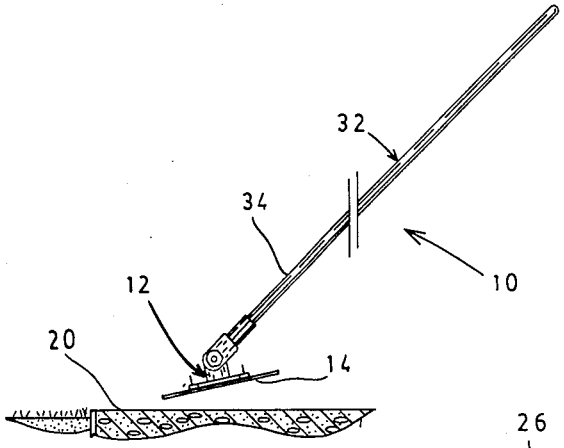
FIG. 1 illustrates an elevation view of a trowel constructed in accordance with various features of the present invention.

The trowel, constructed in accordance with various features of the present invention, is generally illustrated at 10 in FIG. 1. This trowel 10 is designed for surfacing concrete work such as driveways, floors, or the like, and includes a blade assembly, or blade means, 12. This blade assembly 12 has a flexible blade member 14 which is of substantially planar configuration in the illustrated embodiment. The blade 14 is fabricated from a semi-rigid, yet flexible, sheet member such as sheet metal, semi-rigid plastic or the like. It defines a lower surface 16 (see FIG. 4B), which engages and smooths the concrete 20 which is worked by the trowel 10, and includes an upper surface 18.

Figure 2A:
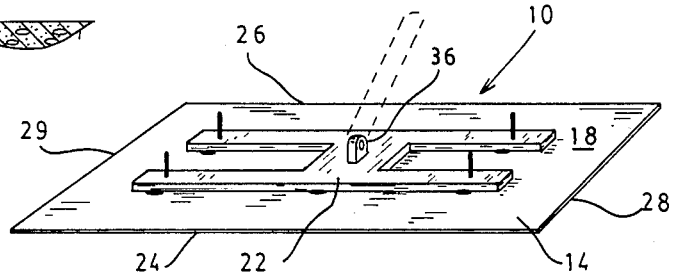
FIG. 2A illustrates a perspective view of the blade assembly.
Figure 2B:
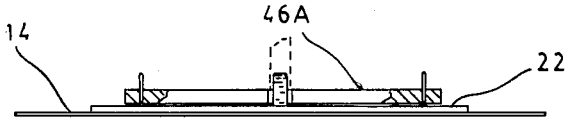
FIG. 2B illustrates an elevation view of the blade assembly depicted in FIG. 2A.
Figure 4A:
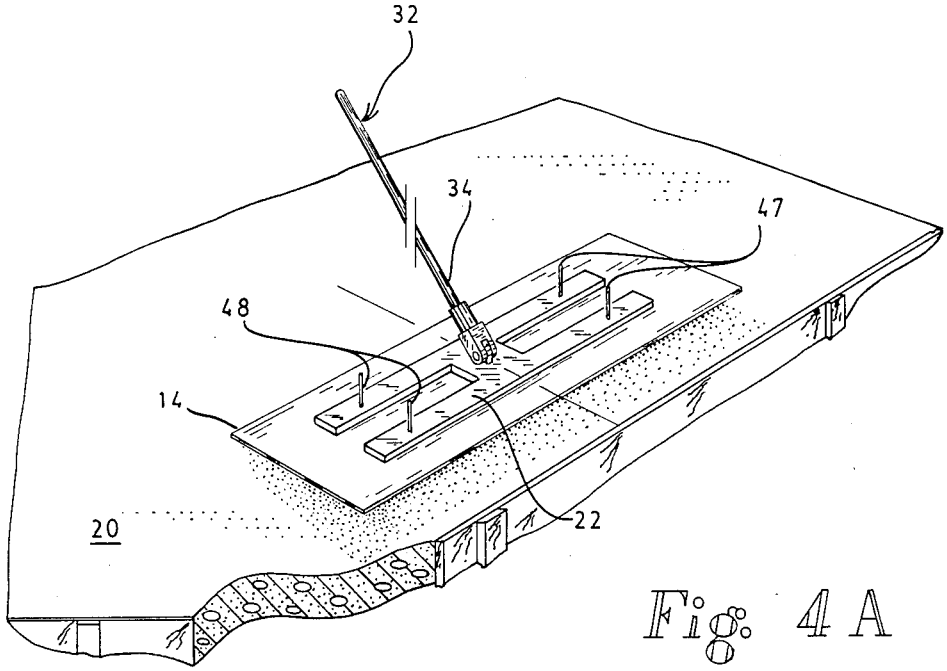
FIG. 4A depicts the blade assembly as it is moved over the surface of freshly laid concrete.

A rib base 22 is carried by this upper surface 18 of the blade member 14 as is depicted in FIGS. 2A and 2B. This rib base 22 in the illustrated embodiment provides reinforcement to the blade member 14. It will be noted that the depicted rib base 22 is mounted, as by welding, on the upper surface of the blade member 14, and is positioned such that it does not overlay the portions of the blade member proximate the blade member perimeter. For example, as shown in FIG. 2A and in FIG. 4A, the rib base 22 is substantially H-shaped, and mounted on the flexible blade member proximate the central portion thereof. This flexible blade member, as illustrated, is substantially rectangular, and includes a pair of longitudinal edges 24 and 26 which are joined at their end portions by a pair of lateral edges 28 and 29 as shown in FIG. 2A. The rib base is mounted at spaced locations from the longitudinal edges of the blade member, such that these edges can flex during troweling operations.

Figure 4B:
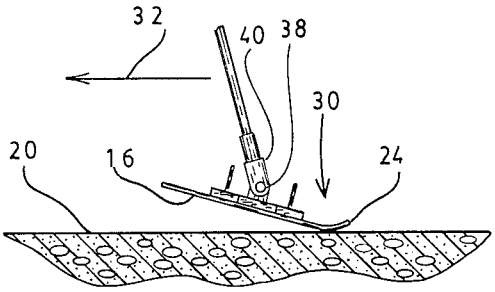
FIG. 4B illustrates the blade assembly and the flexibility of the blade member.

This flexing ability is depicted at the location 30 shown in FIG. 4B. More specifically, when the thrust of the trowel is in the direction of the arrow 32 depicted in FIG. 4B, the longitudinal edge portion 24 of the trowel will flex, enhancing the smoothness of the surface produced in the concrete 20. Thus, the dimensions of this H-shaped base member assists in controlling the degree of the flexibility of a blade member.

A handle generally illustrated at 32 is pivotally connected at its end portion 34 to the blade assembly 12 such that an operator can move the blade member 14 with this handle 32 from a remote location. In the depicted embodiment, the pivotal connection of the handle with the blade assembly is accomplished by the provision of an upright standard member 36. This standard member 36 is mounted proximate the midportion of the rib base, and is provided with an opening which receives a suitable pin, or bolt, 38 which extends through registering openings in the clevis 40 carried by the end portion 34 of the handle 32. The pivotal connection between the handle end portion 34 and the blade assembly allows the blade to pivot with respect to the handle means during troweling operations, thereby further enhancing the smoothness of the surface produced.

Figure 3:
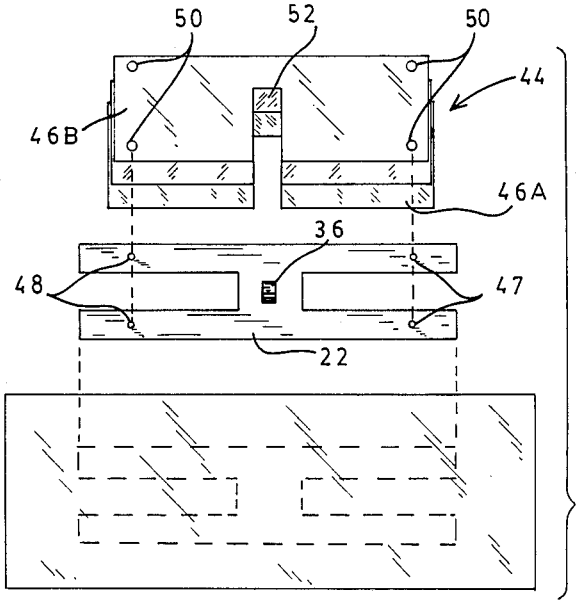
FIG. 3 illustrates a partially exploded view of the blade assembly and adjustable weights which are selectively added thereto to vary the effective weight of the assembly.

Adjustable weights generally illustrated at 44 in FIG. 3 are provided for being selectively added to or taken from the blade assembly 12. In this manner, an operator can vary the effective weight of the trowel to suit the desired use. Weight means 44 are positioned over the blade member 14 at a location spaced from the perimeter thereof to allow the perimeter of the blade member, especially in the longitudinal direction, to flex during troweling operation such that a smoother surface will be produced. In this connection in the preferred embodiment, it will be noted that the perimeter outline of the individual weights 46A–B is such that these weights do not overlay the perimeter of the blade member 14 when mounted on the blade assembly 12. It should be noted (see FIG. 2B) that the rib base 22 serves to vertically space the lowest weight 46A above the blade member to prevent the weights from interfering with the flexing of the blade member even if the cross perimeter outlines of the individual weights overlay the perimeter of the blade member.

Positioning means are provided for fixing the position of the weight means 44 on the blade assembly upon addition of the weights 46A–B thereto. In the illustrated embodiment (see FIG. 3), the positioning means comprises a plurality of posts 47, 48 carried by the rib base 22. These posts 47, 48 are upright members which register with a plurality of openings 50 defined in the weights 46A–B. Thus, these posts will extend through the openings 50 in the weights, and any additional weights stacked, on such weights to fix the horizontal position of the weights with respect to the blade member 14.

As shown in FIG. 3, the weights 46A–B are substantially rectangular in outline, and define an opening 52 for receiving the pivoting end portion of the handle 32 and/or the operatively associated standard 36 therein. The openings 52 in each of the weights 46A–B are positioned at the proximate mid-point of the longitudinal axis of the weights whereby approximately one-half of the mass of each weight is on either side of the location at which the handle means is pivotally connected with the blade assembly, or more specifically at the location of the standard 36. That is, the mass of the weight means is substantially equally distributed on opposite sides of the mid-section of the blade member.

Thus, although there has been described to this point particular embodiments of the present invention of an improved troweling device having adjustable weights, it is not intended that such specific references be considered as limitations upon the scope of the invention, except in so far as set forth in the following claims and equivalents thereof

I claim:

1. A trowel for surfacing unsolidified concrete work such as driveways, floors or the like, by an operator, which comprises:

a rectangular flexible blade member of substantially planar configuration defining a pair of parallel longitudinal edges and a pair of end edges and having a lower surface to contact said concrete work, and an upper surface;

an H-shaped rib base mounted on said upper surface of said blade member to provide reinforcement thereof, said rib base having an upper surface, with legs of said H-shaped rib base extending substantially parallel with said longitudingal edges of said blade member but spaced therefrom sufficiently to permit flexing of said blade member at said longitudinal edges during said surfacing;

handle means having a first end pivotally connected to said rib base proximate a center of said rib base, and a further end for grasp by said operator, whereby said operator can move said blade member with said handle means;

weight engaging means mounted on said upper surface of said rib base; and weight means releasably engaged with said wieght engaging means for being selectively added to or taken from said trowel by said operator to vary the effective weight of said trowel, said weight means not contacting said blade member so as to adversely affect flexing of said blade member, said weight means provided with a notched opening in an edge to receive said first end of said handle means to thereby facilitate said selective adding or removing of said weight means.

2. The trowel of claim 1 wherein said weight engaging means comprises a plurality of upright posts mounted on said rib base, and wherein said weight means is provided with a plurality of openings which register with said upright posts.

3. The trowel of claim 1 wherein said weight means comprises a plurality of weights and each of said weights is substantially rectangular in outline and whereby said outline of said weights is smaller than the outline of said blade member such that said weights are positioned on said trowel at a location spaced from said edges of said blade member thereby allowing said edges to flex during troweling operations.

4. The trowel of claim 1 wherein said rib base includes an upright standard member provided with a transverse opening mounted proximate its mid-portion, and wherein said first end poriton of said handle means carries a clevis which is pivotally connected to said standard with a pivot through said opening thereby allowing said blade means to pivot with respect to said handle means.

5. A trowel for surfacing unsolidified concrete work such as driveways, floors or the like by an operator, which comprises;

a rectangular flexible blade member of substantially planar configuration defining a pair of parallel longitudinal edges and a pair of end edges and having a lower surface to contact said concrete work, and an upper surface;

an H-shaped rib base mounted on said upper surface of said blade member to provide reinforcement thereof, said rib base having legs of said H-shape extending substantially parallel with said longitudinal edges of said blade member but spaced therefrom sufficiently to permit flexing of said blade member at said longitudinal edges during said surfacing, each of said legs of said H-shaped rib base being provided with an upstanding post member proximate an end of said leg;

an upright standard attached to said rib base proximate a central point of said H-shaped rib base, said upright standard provided with a transverse opening;

a handle means having a first end terminating with a clevis and pin for engaging said upright standard at said transverse opening to define a pivot mechanism for said handle means, and a further end for grasp by said operator during said surfacing; and at least one weight member being substantially rectangular in outline, with said outline being smaller than an outline of said blade member to thereby prevent interfering with flexing of said longitudinal edges of said blade member during said surfacing, said weight member being provided with four openings for releasable engagement with said upstanding post members whereby said operator can add to or remove from said rib base said weight member to affect the effective weight of said trowel, and whereby said weight member is further provided with a notched opening along one longitudinal edge to receive said pivot mechanism of said handle means to thereby facilitate said selective adding or removing said weight.

* * * * *